US005910085A

United States Patent [19]

Pruett

[11] Patent Number: 5,910,085

[45] Date of Patent: Jun. 8, 1999

[54] APPARATUS FOR SECURING FLOORS TO ELIMINATE SQUEAKS

[76] Inventor: Phillip H. Pruett, P.O. Box 209, Fairacres, N.M. 88033

[21] Appl. No.: 09/028,160

[22] Filed: Feb. 23, 1998

[51] Int. Cl.[6] ..... A47F 5/00; E04G 23/00

[52] U.S. Cl. ..... 52/291; 52/282.4; 52/289; 52/309.4; 52/480; 52/698; 52/731.9; 52/737.2

[58] Field of Search ..... 52/282.4, 282.5, 52/289, 309.4, 480, 481.1, 781.3, 698, 702, 731.9, 737.2, 291

[56] References Cited

U.S. PATENT DOCUMENTS

| | | | |
|---|---|---|---|
| 1,380,518 | 6/1921 | Bellig . | |
| 1,523,372 | 1/1925 | Hoerr . | |
| 2,014,451 | 9/1935 | Pfeifer . | |
| 2,345,419 | 3/1944 | Olson . | |
| 3,966,056 | 6/1976 | Larson . | |
| 4,199,907 | 4/1980 | Bains et al. . | |
| 4,466,225 | 8/1984 | Hovind | 52/731.9 |
| 4,589,792 | 5/1986 | Niziol . | |
| 4,690,359 | 9/1987 | Phillips . | |
| 4,888,926 | 12/1989 | Lutz, III . | |
| 5,179,813 | 1/1993 | Martinsen et al. . | |
| 5,372,466 | 12/1994 | O'Berry . | |
| 5,403,414 | 4/1995 | Corston | 52/480 X |
| 5,465,548 | 11/1995 | Niese . | |
| 5,497,590 | 3/1996 | Counihan | 52/480 X |
| 5,497,593 | 3/1996 | Riesberg . | |
| 5,577,359 | 11/1996 | McClanahan . | |
| 5,786,849 | 6/1998 | Blazevic | 52/731.9 X |

*Primary Examiner*—Christopher Kent
*Attorney, Agent, or Firm*—Rod D. Baker

[57] ABSTRACT

A floor squeak and pop eliminator. The apparatus includes a two-flanged angle bracket to which is adhered a compressible shim or block. The bracket is fastened to the floor joist in the proximity of the floor noise source, with the compressible shim in contact with the underside of the floor. Screws are turned upward through the bracket and the compressible shim and into the floor, compressing the shim and drawing the floor down to the joist and securing the floor to the shim to eliminate the squeak.

16 Claims, 4 Drawing Sheets

APPARATUS FOR SECURING FLOORS TO ELIMINATE SQUEAKS

BACKGROUND OF THE INVENTION

1. Field of the Invention (Technical Field)

The invention relates to an apparatus for eliminating floor squeaks and pops in conventional and manufactured homes and buildings.

2. Background Art

Flooring systems in typical residential and many commercial buildings include wood joists and a wooden overlayment (subfloor). Wood joists often consist of two-by-ten or two-by-twelve inch boards in residential construction upon permanent foundations, but may be smaller, for example in manufactured homes which are transported from an off-site manufacturing facility. In construction the joists typically are set on edge, and the subflooring secured to the top edge of the joist with nails or staples. Subflooring commonly consists of particle board or plywood sheets. The finished flooring material, such as carpet, tile, linoleum, or the like may then be placed directly upon the subflooring, although it is not uncommon for an intermediate layer of quality material to be placed upon the subflooring to receive the finished flooring material.

Wooden joist-and-subfloor construction are prone to make squeaks and pops when walked upon. This squeaking problem can occur in new and old floors alike, but is most commonly encountered in somewhat older floors, after the wood in the subflooring and/or joists has further dried and shrunk. As the subfloor and/or joist dry, they may warp or shrink with the result that the subfloor pulls up and away from the top of a joist to which it is fastened.

Squeaks and pops can have any of a number of causes. Firstly, the floor noise is detected when weight is introduced to a certain point or vicinity on the floor. The noise is primarily created by the flexure of the subfloor and/or its supporting joist member. Most commonly, the subfloor rubs against the shank of its fastening medium, such as a decking staple or nail, thus causing the noise. Another common source of the noise is that the subfloor may not have been securely fastened to the floor joist, thereby creating a small gap between the subfloor and the joist. When weight is introduced upon an inadequately fastened sub floor, the floor will make a "pop" noise.

A solution to these floor noises is simple if, in new construction, the finished flooring has not been installed over the subfloor. If the finished floor has not been laid, squeaks and pops may be solved by re-fastening the subfloor to the joist by installing additional decking staples, nails, or screws through the top of the subfloor into the joist. However, if the finished flooring is installed over the area of the noise, it is not practical to repair from the top side, as the finished flooring would have to be removed. Once finished flooring is in place, the only practical solution is to repair the noise from beneath the floor.

Squeaky floors can be nearly completely avoided by using screws, rather than nails or staples, in initial construction. The use of screws in flooring construction, however, normally is prohibitively expensive.

A number of previous efforts have been undertaken to address the problem of squeaky floors. For example, U. S. Pat. No. 4,888,926, to Lutz, III, teaches a floor squeak elimninator which utilizes several parts, including a bracket that mounts to the bottom of a joist, and requires two tools for installation. The device applies downward pressure on the sub floor at a single isolated point, so that if the source of the squeak is not exactly located, the device may not eliminate the squeak.

U. S. Pat. No. 5,497,593, to Reisberg, shows a device consisting of a narrow L-shaped bracket with a built-in wedge on one leg. Requiring two tools for installation, the device's wedge is intended to be hammered into position between the subfloor and the joist, which may loosen the subfloor adjacent to the wedge and actually create additional squeaks.

U. S. Pat. No. 5,577,359, to McClanahan, teaches a device consisting of a threaded rod assembly of four parts and requires at least three tools to install. It is intended to mount between floor joists and pull down on that portion of the subfloor disposed between the joists, potentially causing an acceptable dip in the subfloor. U.S. Pat. No. 5,372,466 to O'Berry, and U.S. Pat. No. 5,179,813 to Martinsen, et al., also proffer supposed solutions to the problem of squeaky floors.

Yet, a need remains for a simple apparatus, useable with a minimum number of tools, for installation beneath a floor to reduce squeaks. The present invention effectively eliminates floor noises by preventing the flex of a wooden flooring system. The invention is useable beneath an existing or older flooring system, and thus can be beneficially practiced despite the presence of an installed finished flooring.

SUMMARY OF THE INVENTION (DISCLOSURE OF THE INVENTION)

The invention relates to an apparatus for drawing and securing two items together; specifically, the apparatus draws together and secures a floor and a joist. By securing the floor to the joist, movements of the floor, and thus floor squeaks, are reduced or eliminated.

In accordance with the invention, there is provided an apparatus for securing a first item, such as a joist, against a second item, such as a subfloor, the apparatus comprising a main body fixedly fastenable to the first item, an inelastically compressible member attached to the main body and disposable against the second item, and at least one spirally threaded connector turnably disposable through the main body and through the compressible member and into the second item, so that when the main body is fastened to the first item and the compressible member is disposed against the second item, the connector when turned into the second item draws the second item toward the main body thereby compressing the compressible member. The main body preferably comprises an angled bracket, and most preferably the bracket defines a right angle. The compressible member preferably comprises a parallelepiped block, such as a block of crushable styrene plastic foam. The at least one connector comprises at least one screw.

Also in accordance with the invention, there is provided an apparatus for drawing and securing together a joist and a floor in substantially perpendicular relation, the apparatus comprising: a bracket comprising a first flange disposable against the joist and a second flange perpendicularly integrally connected to the first flange, at least one means for fastening the first flange to the joist, a compressible shim attached to the second flange, and at least one screw, turnably disposable through the second flange and the compressible shim and into the floor, for making a screwed connection between the compressible shim and the floor so that when the first flange is fastened to the joist, and when the at least one screw is turned into the floor, the floor is drawn to the joist and toward the second flange thereby compressing the shim between the floor and the second flange. The first flange and the second flange preferably intersect to define a right angle. The compressible shim preferably is glued to the second flange, and the compressible shim preferably comprises a block of non-resilient plastic. Preferably, the means for fastening comprises a member selected from the group consisting of screws, bolts, and nails.

A primary object of the present invention is to provide a simple apparatus for eliminating annoying squeaks and pops in floors, which apparatus is easy to use in confined spaces.

A primary advantage of the apparatus of the present invention is that it has very few components and may be installed using a single tool.

Another advantage of the apparatus of this invention is that it is readily mass manufactured at a low cost-per-item basis.

Another advantage of the apparatus is that it permits a spirally threaded connector, such as a wood screw, to be used to pull a floor down to a joist, yet the apparatus itself poses no significant resistance to the downward movement of the floor during the securing process.

Still another advantage of the invention is that the fasteners used therewith are at all times easily accessible to the user.

Yet another advantage of the invention is that it safeguards against the accidental use of unacceptably long screws into the subfloor.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The present invention is an apparatus for remediating or ameliorating squeaks and pops in the floors of conventional and manufactured housing or commercial structures. The invention finds beneficial use in buildings having a standard joist-and subfloor construction. Unlike certain devices known in the art, the apparatus of the invention is useable in instances of double- or triple-joist construction, where two or more joists are located in flush parallel contact to support the floor. In this specification and the claims, "floor" shall include "subfloor" unless otherwise indicated. While the invention is intended primarily for use with wood joists and subfloors, it is apparent to one of ordinary skill in the art that the invention may be adapted for use in conjunction with joists or subflooring fashioned from other materials. Moreover, while the invention finds immediate use to secure sub floors to joists to eliminate squeaks, it will be readily apparent that beneficial use may also be achieved in various other circumstances in which it is desired to secure two items, such as planar items, against each other or together in a substantially perpendicular positional relationship. For example, the invention may be used to secure kitchen countertops to their supporting frames, or to secure stair treads to stair risers, roofing boards to roof trusses, or the like.

The invention is an integral unit requiring only one tool for installation, and can be installed in nearly all types of joist configurations, or in nearly any other situation where it is desired to secure together a first item and a second item in perpendicular relation. Broadly described, the preferred embodiment of the invention is a main body fixedly fastenable to the first item, and an inelastically compressible member attached to the main body and disposable against the second item, and at least one spirally threaded connector turnably disposable through the main body, through the compressible member and into the second item, so that when the main body is fastened to the first item and the compressible member is disposed against the second item, the connector when turned into the second item draws the second item toward the main body thereby compressing the compressible member.

The apparatus preferably is a single unit including two components, the main body being a right-angle bracket and the compressible member being, for example, a plastic foam shim. The compressible shim is secured to the upper or outside face of one of the flanges of the bracket, and holes preferably are provided in both the flanges of the bracket to permit the entire unit to be screwed or otherwise attached to the subfloor and joist. The particular function and cooperation of the compressible shim and bracket during the installation process permits the subfloor to be drawn and secured to the top of the joist.

Figure 1:
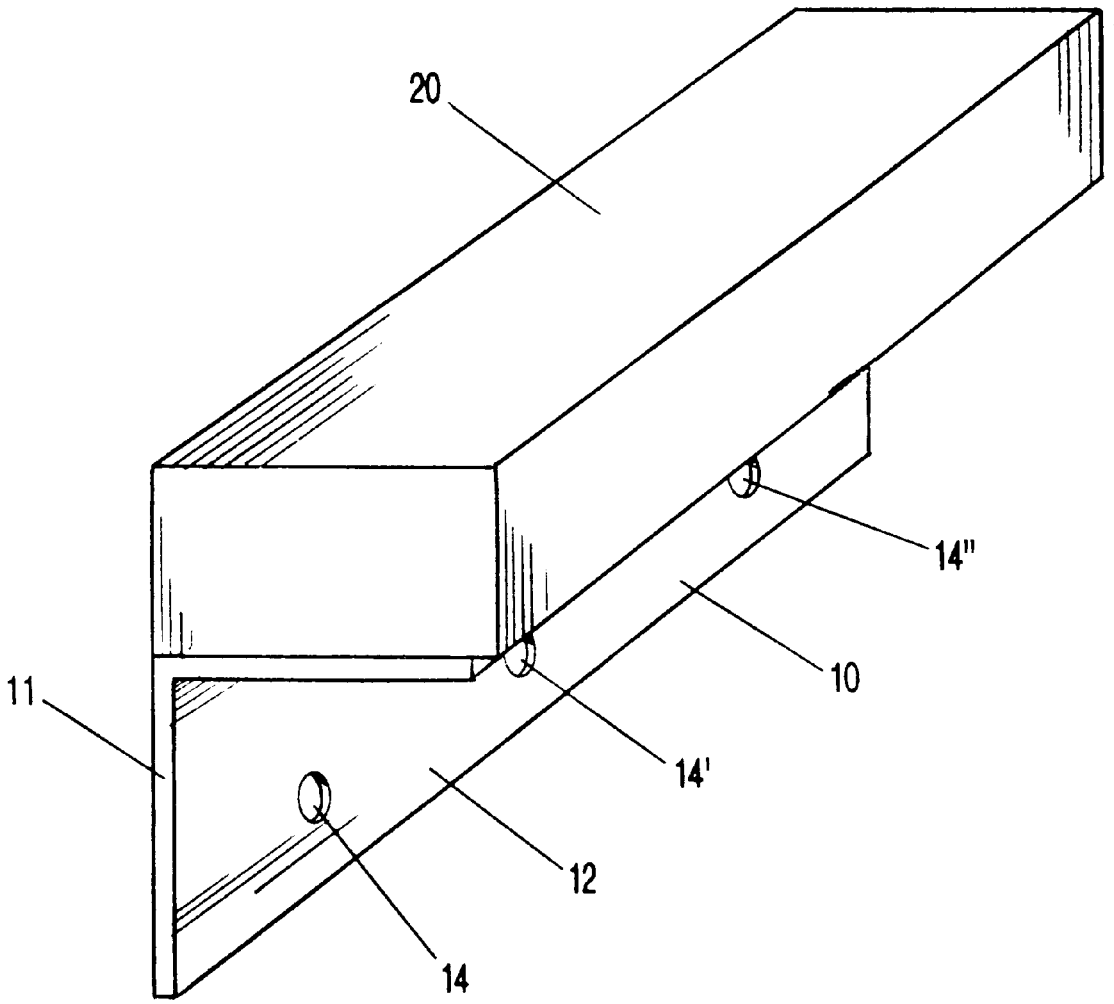
FIG. 1 is a perspective view, from above, of the left side of a preferred embodiment of the apparatus of the invention.

Attention is invited to FIG. 1, showing the details of a preferred embodiment of the invention. As mentioned, the apparatus includes a bracket 10 with a shim 20 attached thereto. The bracket 10, which functions as the main body of the apparatus, preferably is fashioned from a rigid, substantially unbendable material such as aluminum, steel, iron or other metal or metallic alloys, although alternative embodiments may be made from strong plastics or resin composites. The bracket 10 very preferably is an "angle iron" type bracket having a first flange 11 and a second flange 12 which are integrated to define a right angle. In one embodiment, the bracket 10 is fashioned from metal about 0.125 inches thick, bent to a right angle with flanges 11, 12 about 1.5 inches wide, with the overall axial length of the flange 10 being about 4.0 inches, although these dimensions are by way of example rather than critical limitation. The apparatus may be manufactured in a variety of sizes for custom installations. Particularly, the apparatus can be manufactured in various different lengths to permit the practice of the invention to be adapted to the circumstances of a particular problem; longer lengths extend the length of the effective "pressure point," while short "stub" embodiments are desirable for use in a comer or other cramped location. Longer embodiments avoid the drawback of potentially misplaced, unduly focused single pressure point application.

The flanges 11, 12 preferably are substantially identical, so that description of one serves to describe the other. Continuing reference to FIG. 1 shows that the first flange 11 is penetrated by at least one, and preferably about three holes 14, 14' 14" therethrough. Holes 14, 14' 14" permit the insertion of fasteners wherewith to attach the first flange 11 to ajoist or other article. The holes 14, 14' 14" preferably are uniformly spaced along the length of the first flange 11, about midway on the width of the flange 11. Although not shown in FIG. 1, the second flange 12 preferably has a substantially identical set of holes therethrough to permit the use of screws as a means of connection.

In use, the bracket 10 is oriented as shown in the figures, that is, with the first flange 11 vertical and the second flange 12 angling (e.g. at 90 degrees) away from the upper edge of the first flange 11. Thus, the second flange 12 is above the first flange 11 with the first flange 11 descending downward from an edge of the second flange 12.

On the upper or outside surface of the second flange 12 is attached a compressible shim 20. The shim 20 is a rectilinear, parallelepiped block of compressible material. Most preferably, the shim 20 is made of an inelastically compressible material which collapses or compacts under any significant load, yet does not possess any physical "memory" which induces a rebound or expansion to the pre-load shape. The shim 20 may desirably be fashioned from a crushable foam plastic, such as a closed cell styrene foam, for example STYROFOAM® plastic. Plastic foam which has significant elastic memory, which generates an expansive force in reaction to loading, is undesirable. Shim 20 preferably also is crafted from a material which will take the bite of a screw, such that the shim will receive and hold threaded fasteners turned therethrough. Again, STYROFOAM® plastic blocks are an affordable and practical material from which the shim 20 may be composed. Alternatively, the shim 20 may comprise other crushable substances, such as corrugated cardboard, wadded paper, honeycombed plastic or lightweight alloys, or the like.

The shim 20 may have dimensions, in a exemplary embodiment, of about 4.0 inches long by about 1.5 inches wide by about 0.875 inches thick, the former two dimensions being generally equal to corresponding dimensions of the second flange 12 to which the shim 20 is attached. The shim 20 need not be coextensive with the lateral extent of the second flange 12, however, and acceptable alternative embodiments of the apparatus may feature a shim 20 somewhat narrower in width than the width of the second flange 12. Notably, upon vertical loading the shim 20 compresses or collapses to reduce substantially the thickness thereof.

The shim 20 preferably is permanently attached to the second flange 12 in flush parallel contact therewith. The attachment may be accomplished, for example, by gluing the bottom of the shim 20 to the top of the second flange 12, in the position shown in FIG. 1.

Figure 2:
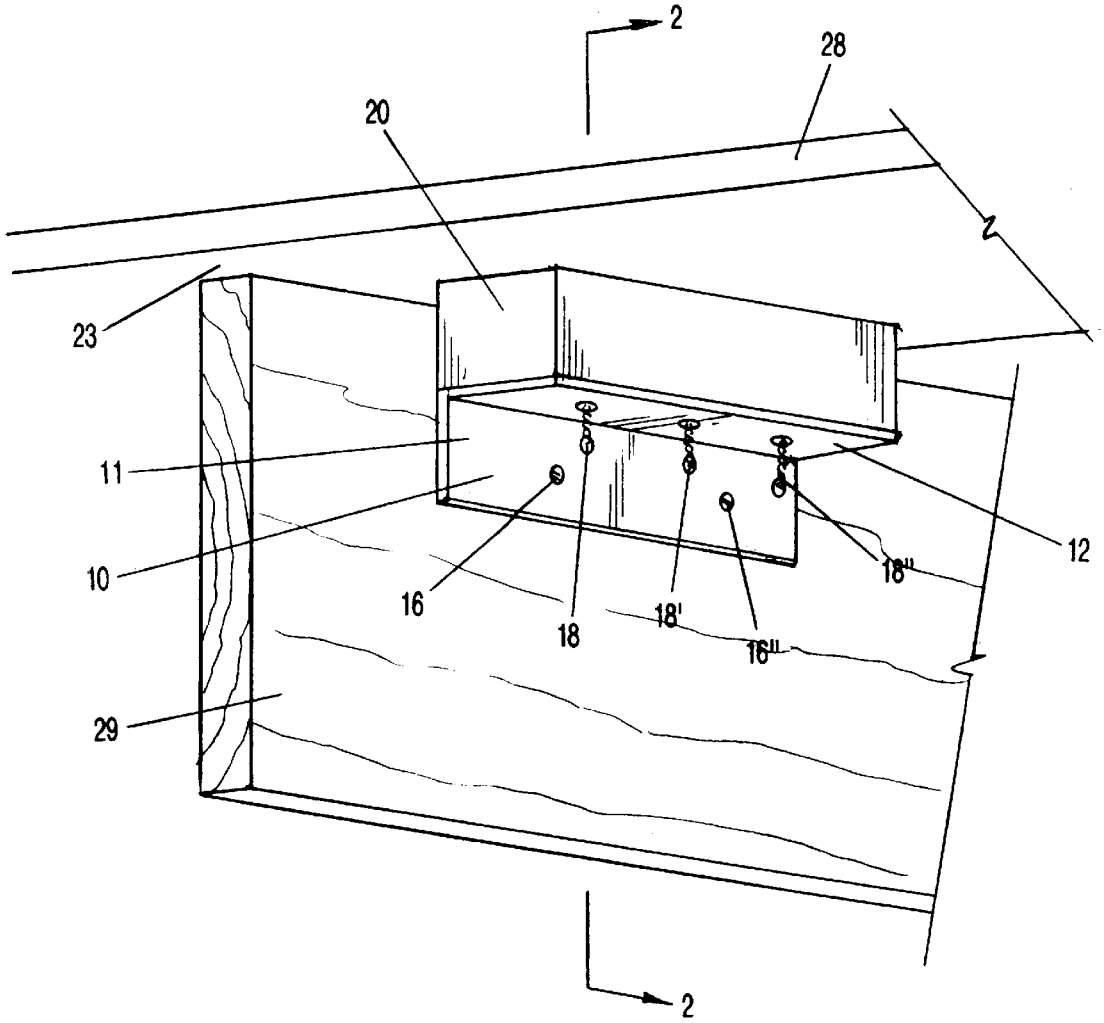
FIG. 2 is a perspective view, from below, of the embodiment depicted in FIG. 1, showing the apparatus partially installed upon a joist and subfloor which are spaced slightly apart.
Figure 3:
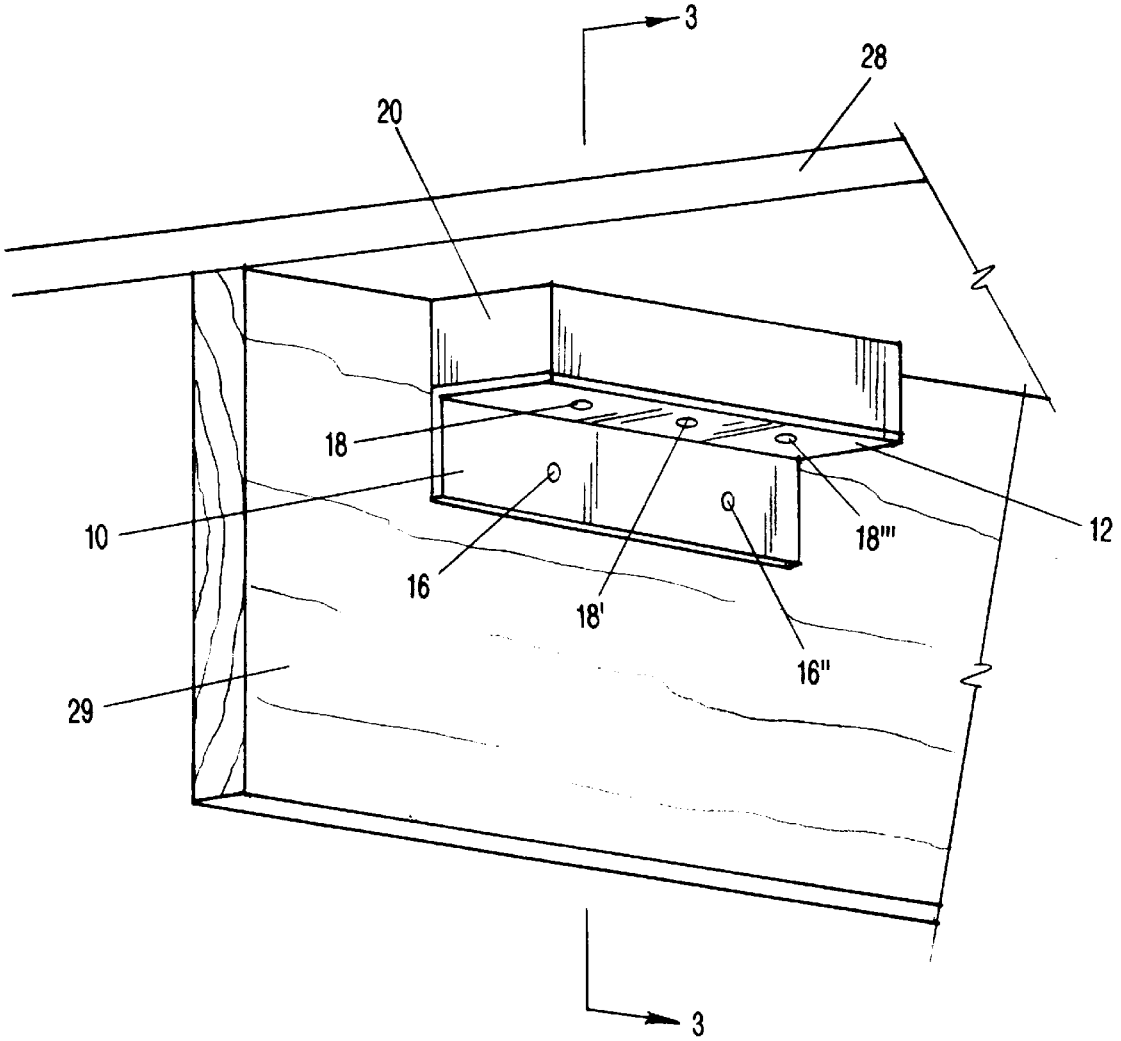
FIG. 3 is a perspective view of the embodiment depicted in FIG. 2, showing the apparatus fully installed upon ajoist and subfloor which have been drawn together.

Combined reference to FIGS. 2–5 shows by way of example the practice of the invention to secure a portion of a generally horizontal subfloor 28 to a vertically disposed joist 29. Alternative uses of the invention include the securing together of practically any other pair of items in generally perpendicular relation. Reference to the figures thus illustrates that the invention includes an apparatus for drawing and securing together a first item, such as the joist 29, and a second item, such as the subfloor 28, in substantially perpendicular relation. The bracket 10 has its first flange 11 disposable flush against the side of the joist 29, with the second flange 12 perpendicularly integrally connected to the first flange 11. There is provided at least one means for fastening the first flange 11 to the joist 29, the preferred means being conventional wood screws 16, 16', although alternative embodiments may employ bolts or nails as fasteners 16, 16'. FIGS. 2 and 3 show two joist screws 16, 16' in a corresponding number of holes in the first flange 11; as previously explained, the joist screws 16, 16' number at least one, and preferably three or four.

The compressible shim 20 is attached to the second flange 12, and at least one, preferably three fasteners 18, 18', 18" are turnably disposable through the second flange 12 and through the compressible shim 20. The fasteners 18, 18', 18" are spirally threaded connectors, and very preferably are self-tapping wood screws. The subfloor screws 18, 18', 18" are also turnable, in their maximum penetration, into the subfloor 28, thus eventually providing a screwed connection between the compressible shim 20 and the subfloor 28. Accordingly, when the first flange 11 is fastened to the joist 29, and when at least one subfloor screw 18 is turned into the subfloor 28, the subfloor is drawn down to the joist 29 and toward the second flange 12, compressing the shim 20 between the subfloor 28 and the second flange 12.

The practice of the invention may be briefly described. Combined reference first is made to FIGS. 2 and 4. As seen in those figures, there initially is a gap 23 between the top of the joist 29 and the bottom surface of the subfloor 28. Such a gap permits the subfloor 28 to flex up and down when periodically loaded (such as when a person walks across the floor). The up-and-down flexure of the subfloor 28 causes, for example, the subfloor to rub up-and-down along the shank of a nail (not shown) which previously was driven through the subfloor and into the joist 29. Warping or shrinkage in joist 29 and/or subfloor 28 has opened the gap 23, which gap remains spanned by the flooring nail (not shown). Closure of the gap 23 by securing with the invention the subfloor 28 to the top of the joist 29 prohibits the subfloor from flexing, thus remediating the resulting annoying squeak.

Figure 4:
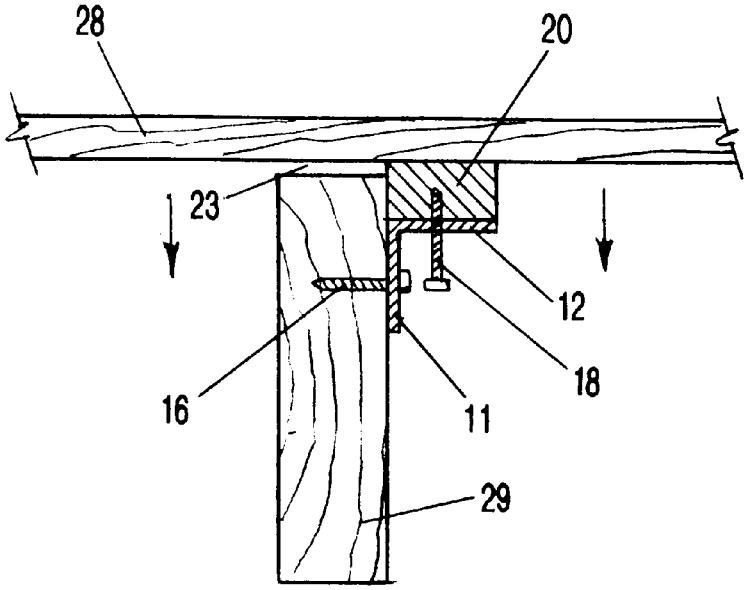
Fig. 4 is a side sectional view of the apparatus depicted in FIG. 2, taken generally along section 2—2 in FIG. 2.

The user of the invention accesses the area under the floor by entering the crawlspace or cellar beneath the building. The apparatus of the invention is disposed into the position shown in FIGS. 2 and 4, with the first flange 11 placed against the side of the joist 29. Notably, the top surface of the shim 20 also is placed flush against the bottom surface of the subfloor 28, as best depicted in FIG. 4. The second flange 12, however, is disposed below the top of the joist 29; the bracket 10 thus imposes no impediment to the subfloor 28 being pulled down to the joist 29. Reference to FIG. 4 also illustrates that the uncompressed shim 20 projects above the top surface of the joist 29 in order to attain contact with the subfloor 28, due to the existence of the gap 23.

In the preferred embodiment, and as seen in FIGS. 2 and 4, the unused apparatus of the invention is provided with subfloor screws 18, 18', 18" partially driven through the second flange 12 and into the shim 20. Shim 20 holds the screws 18, 18', 18" in the partially inserted disposition shown in FIGS. 2 and 4 while the apparatus of the invention is jockeyed into place. The partially driven screws 18, 18', 18" are thus pre-positioned for the user, eliminating the need for the user to fumble about in the dark confines of a crawlspace to manipulate screws into driving position.

With the bracket 10 and shim 20 manipulated into contact with the joist 29 and subfloor 28 respectively, the first flange 11 is fastened to the joist 29, preferably by turning screws 16, 16' of appropriate lengths through the first flange 11 and into the joist 29, as with a screwdriver. With the bracket 10 thus mounted upon the joist 29, the user's hands are freed from the task of holding the apparatus in place while completing the installation.

Figure 5:
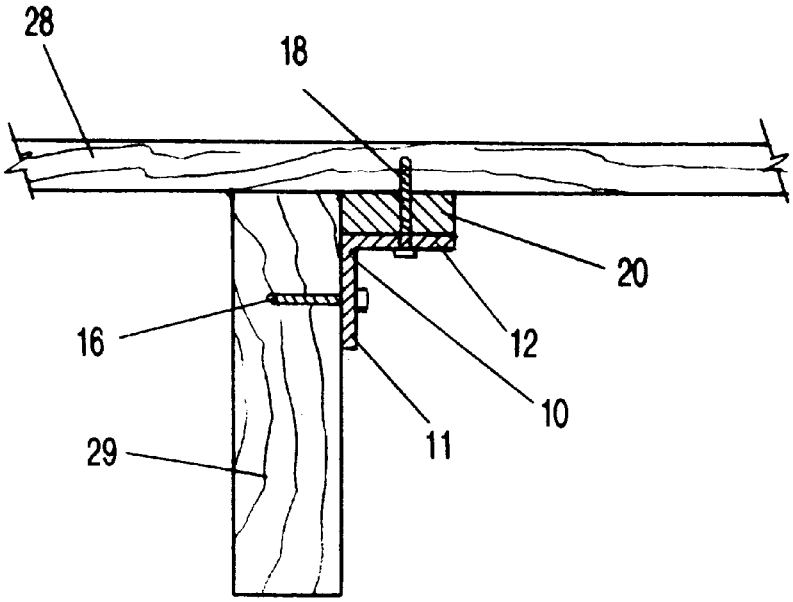
FIG. 5 is a side sectional view of the apparatus depicted in FIG. 3, taken generally along section 3—3 in FIG. 3.

The user then turns, as with a power screwdriver, the subfloor screws 18, 18', 18" to drive the screws the rest of the way through the shim 20 and into the subfloor 28. Notably, as ; the screws 18, 18', 18" are turned into the subfloor 28, the screwing action pulls the subfloor down as indicated by the directional arrows of FIG. 4. Since the bracket 10 and thus the second flange 12 are immovably attached to the joist 29, the connecting action of the rotating screws 18, 18', 18" cannot move the bracket 10 but instead moves the subfloor 28. The screws 18, 18', 18" are driven until their respective heads are in contact with the second flange 12, at which time the installation is complete and the subfloor 28 has been pulled down, by the screws, toward or preferably against the top of the joist 29 as seen in FIGS. 3 and 5. During the movement of the subfloor 28 toward the joist 29, the shim 20 collapses from the condition shown in FIGS. 2 and 4 to a compressed condition of reduced volume depicted in Figs.3 and 5.

An advantage of the invention is that the shim 20 takes the bite of the rotating screws 18, 18', 18", thereby permitting the subfloor 28 to be pulled downward by the screws, and yet the shim 20 compresses as needed to fill the shrinking distance between the second flange 12 and the bottom of the subfloor 28. Advantageously, the entire rigid bracket 10, particularly the second flange 12, is disposed below the top of the joist 29 throughout installation and practice of the invention, and thus does not interfere with the free descent of the subfloor 28 to the top of the joist 29. Likewise the shim 20, being compressible, collapses rather than impeding the movement of the subfloor 28 and joist 29 toward each other.

Thus, as the gap 23 desirably is closed by the action of the screws 18, 18', 18", and the shim 20 is compressed between the subfloor 28 and the bracket 10 to allow the subfloor to be pulled into proper position against the joist 29. And, because the shim 20 preferably is inelastic and non-resilient, when in the compressed and collapsed condition depicted in FIGS. 3 and 5, it does not exert a counterproductive upward force upon the subfloor 28 which would tend to reopen the gap 23. Shim 20 there for permits the apparatus of the invention at the outset to be placed across the gap 23 and in contact with the subfloor 28 in order that screws may efficiently be driven into the subfloor, and yet the apparatus collapses to permit the proper juncture of the subfloor to the joist 29 as the two are drawn and secured together.

Notably, the subfloor screws 18, 18', 18" preferably are preselected for appropriate length, and then partially predriven into the shim 20, as seen in FIG. 2, at an off-site location. The user may then confidently drive the screws 18, 18', 18" into the subfloor 28 until the heads are in contact with the second flange 12, with the knowledge that the screws 18, 18', 18" are not too long. Subfloor screws 18, 18', 18" that are too long, of course, will emerge from the top of the subfloor 28, thereby potentially damaging the finished flooring and/or posing an injury hazard.

Installation and use of the apparatus is simplified by the ready access to the fasteners 16, 16' and 18, 18', 18". The invention avoids the difficulty, commonly encountered in the art, of having to use more than one tool to manipulate poorly accessible fasteners or turnbuckles on complex or cramped devices.

With the apparatus installed as shown in FIGS. 3 and 5, the subfloor 28 is permanently secured to the joist 29 and the gap 23 is eliminated. The subfloor 28 being thus unable to flex up and down, annoying squeaks and/or pops are banished.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for securing a first item against a second item, said apparatus comprising:

a main body fixedly fastenable to the first item;

an inelastically compressible member attached to said main body and disposable against the second item; and at least one spirally threaded connector turnably disposable through said main body and through said compressible member and into the second item;

wherein when said main body is fastened to the first item and said compressible member is disposed against the second item, said connector when turned into the second item draws the second item toward said main body thereby compressing said compressible member.

2. An apparatus according to claim 1 wherein said body comprises an angled bracket.

3. An apparatus according to claim 2 wherein said bracket defines a right angle.

4. An apparatus according to claim 1 wherein said compressible member comprises a parallelepiped block.

5. An apparatus according to claim 4 wherein said block comprises a crushable styrene plastic foam.

6. An apparatus according to claim 1 wherein said at least one connector comprises at least one screw.

7. An apparatus for drawing and securing together a joist and a floor in substantially perpendicular relation, said apparatus comprising:

a bracket comprising:

a first flange disposable against the joist; and a second flange perpendicularly integrally connected to said first flange;

at least one means for fastening said first flange to the joist;

a compressible shim attached to said second flange; and at least one screw, turnably disposable through said second flange and said compressible shim and into the floor, for making a screwed connection between said compressible shim and the floor;

wherein when said first flange is fastened to the joist, and when said at least one screw is turned into the floor, the floor is drawn to the joist and toward said second flange thereby compressing said shim between the floor and said second flange.

8. An apparatus according to claim 7 wherein said first flange and said second flange intersect to define a right angle.

9. An apparatus according to claim 8 wherein said compressible shim is glued to said second flange.

10. An apparatus according to claim 7 wherein said compressible shim comprises a block of non-resilient plastic.

11. An apparatus according to claim 10 wherein said means for fastening comprises a member selected from the group consisting of screws, bolts, and nails.

12. An apparatus for remediating a squeaky floor by drawing and securing the floor to a joist, comprising:

an angle bracket comprising:

a first flange attachable to a vertical side of the joist; and a second flange angled from said first flange, wherein said bracket is disposable on the joist to place said second flange below the top of the joist;

at least one spirally threaded connector; and a compressible shim, attached to an upper face of said second flange, for receiving said at least one spirally threaded connector therethrough;

wherein said spirally threaded connector is turnably disposable through said second flange and said compressible member and into the floor, and wherein when said first flange is fastened to the joist with said second flange below the top of the joist, and said at least one connector is turned into the floor, the floor is drawn to the joist.

13. An apparatus according to claim 12 wherein when said shim member is compressible between the floor and said second flange when the floor is drawn to the joist.

14. An apparatus according to claim 12 wherein said first flange and said second flange intersect to define a right angle.

15. An apparatus according to claim 12 wherein said compressible shim is glued to said second flange.

16. An apparatus according to claim 12 wherein said compressible shim comprises a block of non-resilient plastic foam.

* * * * *